United States Patent [19]

Williams, III

[11] Patent Number: 4,969,627

[45] Date of Patent: Nov. 13, 1990

[54] ROD LOCKING DEVICE

[75] Inventor: Charles C. Williams, III, Houston, Tex.

[73] Assignee: Cameron Iron Works USA, Inc., Houston, Tex.

[21] Appl. No.: 923,592

[22] Filed: Oct. 27, 1986

[51] Int. Cl.[5] ..... F15B 15/26

[52] U.S. Cl. ..... 251/1.3; 92/24

[58] Field of Search ..... 251/1.1, 1.3; 92/23, 92/24, 27, 28; 70/181

[56] References Cited

U.S. PATENT DOCUMENTS

| | | | |
|---|---|---|---|
| 1,836,506 | 12/1931 | Rasmussen et al. | 251/1.3 X |
| 3,208,357 | 9/1965 | Allen et al. . | |
| 4,052,995 | 10/1977 | Ellison | 251/1.3 X |
| 4,293,115 | 10/1981 | Parks, Jr. et al. | 251/1.3 |
| 4,523,639 | 6/1985 | Howard, Jr. | 251/1.3 X |
| 4,601,232 | 7/1986 | Troxell, Jr. | 251/1.3 X |

FOREIGN PATENT DOCUMENTS

| | | | |
|---|---|---|---|
| 947389 | 7/1980 | U.S.S.R. | 251/1.3 |

*Primary Examiner*—John C. Fox

[57] ABSTRACT

The improved blowout preventer ram tail rod locking device of the present invention includes a housing, a body movable in the housing, having a threaded rod and coacting with the outer end of the ram tail rod to lock it in the ram closed position, a nut rotatably mounted within said housing, having ractchet teeth and engaging the threads onthe threaded rod, a braking piston slidably mounted within said housing and having ratchet teeth engaging withthe ratchet teeth of the nut, the ratchet teeth on said nut and piston allowing freedom of rotation of the nut during movement of the body into engagement with the ram tail road and preventing rotation of the nut in the opposite direction, and menas for exerting pressure on said braking piston to disengage the racthet teeth during retracting movement of the wedge.

5 Claims, 3 Drawing Sheets

ROD LOCKING DEVICE

BACKGROUND

The present invention relates to an improved rod locking device having particular application to locking the tail rod of a blowout preventer ram in position to prevent movement of the ram once it has been closed.

When oilfield ram type blowout preventers are in use, it occasionally becomes necessary to lock the rams in the closed position. The prior art of blowout preventers has numerous devices for locking a ram in its closed position. Such devices range from a simple mechanical screw which is threaded through the bonnet to engage the outer end of the ram tail rod or piston to prevent its movement in the outward direction to complicated devices such as shown in U.S. Pat. No. 4,305,565 wherein a locking cone responds to fluid pressure during the movement of the ram to move the locking wedges into engagement with the tapered inner surfaces of the housing.

Prior to the present invention rod locking devices have included wedges actuated by pistons which are actuated when the rod is in its position for locking and the wedges are moved into locking engagement with a tapered surface on the rod to prevent retraction of the rod from its locked position. A typical example of this type of device is disclosed in U.S. Pat. No. 3,208,357, issued Sept. 28, 1965 to H. Allen et al.

Other prior art patents, such as U.S. Pat. Nos. 4,052,995, 4,076,208 and 4,290,577 disclose ram locks wherein a lock nut is stopped from rotating by a clutch mechanism which has ratchet teeth.

SUMMARY

The improved rod locking device of the present invention has particular application to lock a blowout preventer ram in its closed position. The improved device includes a housing, a body movable in the housing, having a threaded rod and coacting with the outer end of the ram tail rod to lock it in the ram closed position, a nut rotatably mounted within said housing on the threads of the threaded rod, having ratchet teeth and a braking piston slidably mounted within said housing and having ratchet teeth engaging with the ratchet teeth of the nut, the ratchet teeth on said nut and piston allowing freedom of rotation of the nut during movement of the body into engagement with the ram tail rod and preventing rotation of the nut in the opposite direction, means for exerting pressure on said braking piston to disengage the ratchet teeth during retracting movement of the body.

An object of the present invention is to provide an improved ram locking device which is reliable to ensure complete and prompt locking and retracting movement.

Another object is to provide an improved ram locking device having a minimum number of moving parts.

A further object of the present invention is to provide an improved ram locking device which ensures that the locking member is positively released and retracted from its locked position.

BRIEF DESCRIPTION OF THE DRAWINGS

These and other objects and advantages are hereinafter set forth and explained with reference to the drawings wherein.

BRIEF DESCRIPTION OF THE DRAWING

Figure 1:
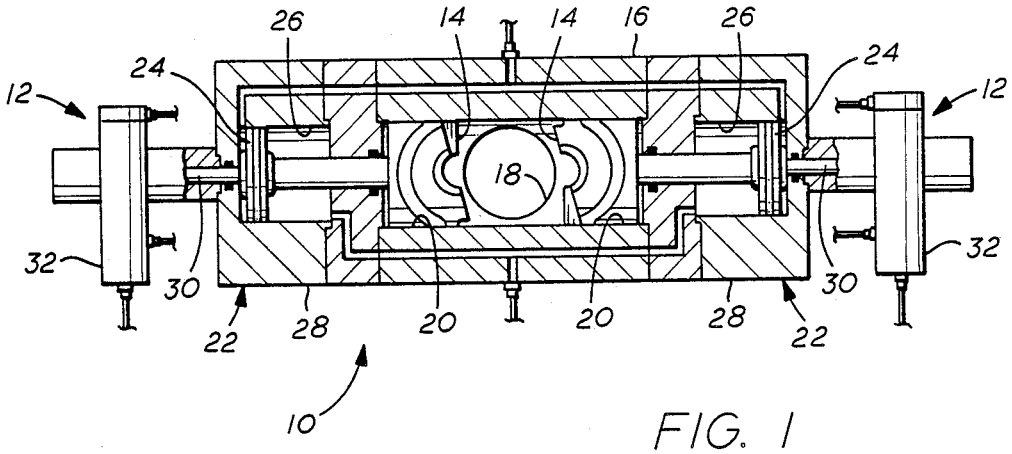
FIG. 1 is a schematic sectional view of a ram type blowout preventer with the improved ram lock apparatus of the present invention installed on both bonnets.

Blowout preventer 10 shown in FIG. 1 includes an improved lock 12 of the present on each of its each of its rams 14. Blowout preventer 10 includes the housing 16 having a central bore 18 extending therethrough and opposed, aligned guideways 20 extending outwardly from such bore 18 in which the rams 14 are positioned. Rams 14 are moved in guideways 20 by pressure responsive means 22, normally a piston 24 reciprocally positioned in a cylinder 26 defined within the bonnet 28. Tail rod 30 is secured to the outer side of piston 24 and extends through the outer end of bonnet 28 into lock housing 32 as shown. Lock housing 32 is suitably secured to bonnet 28 as by threads (not shown).

Figure 2:
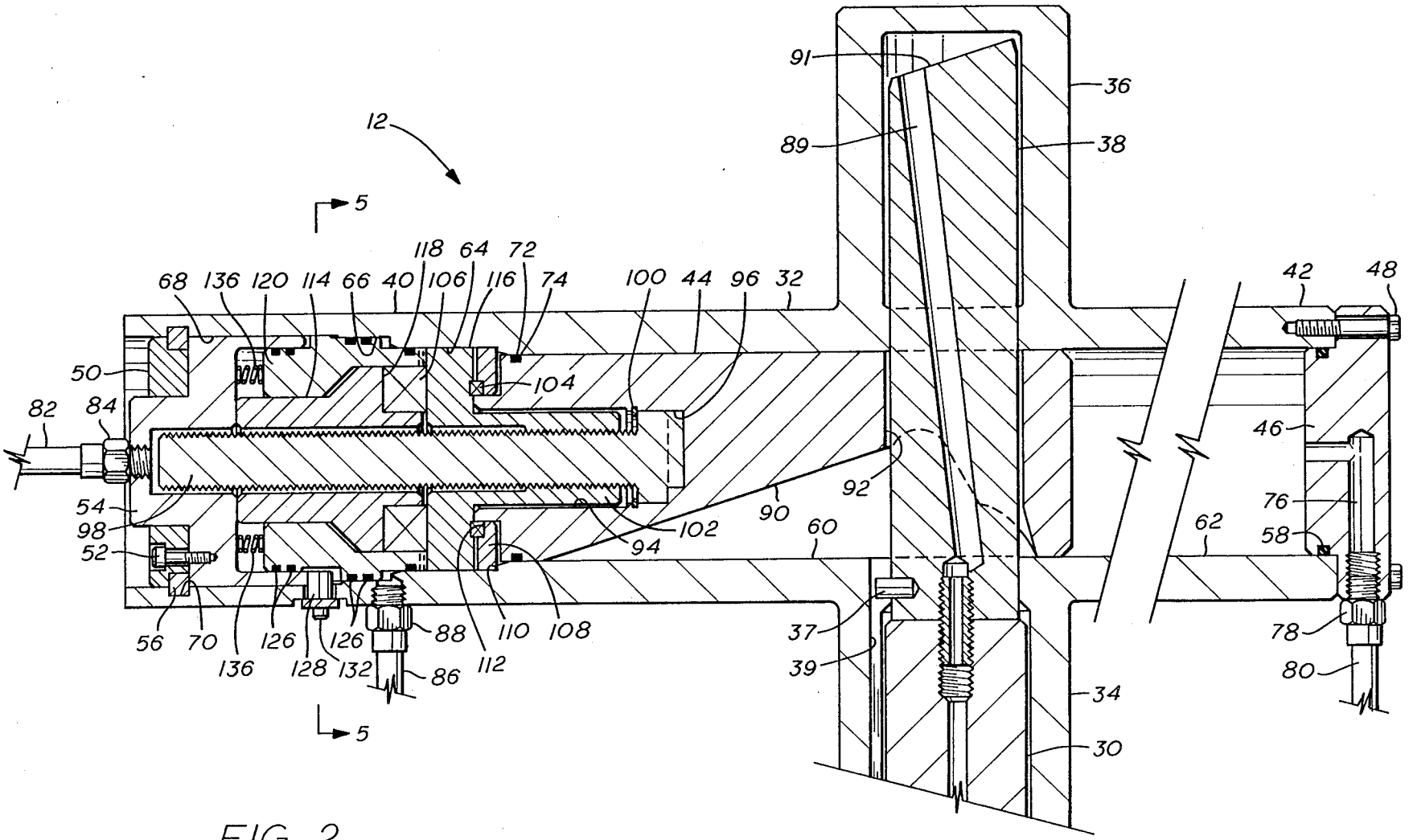
FIG. 2 is a sectional view of the ram lock apparatus of the present invention with the ram lock in its unlocked or retracted position and the ram tail rod in its open position.
Figure 3:
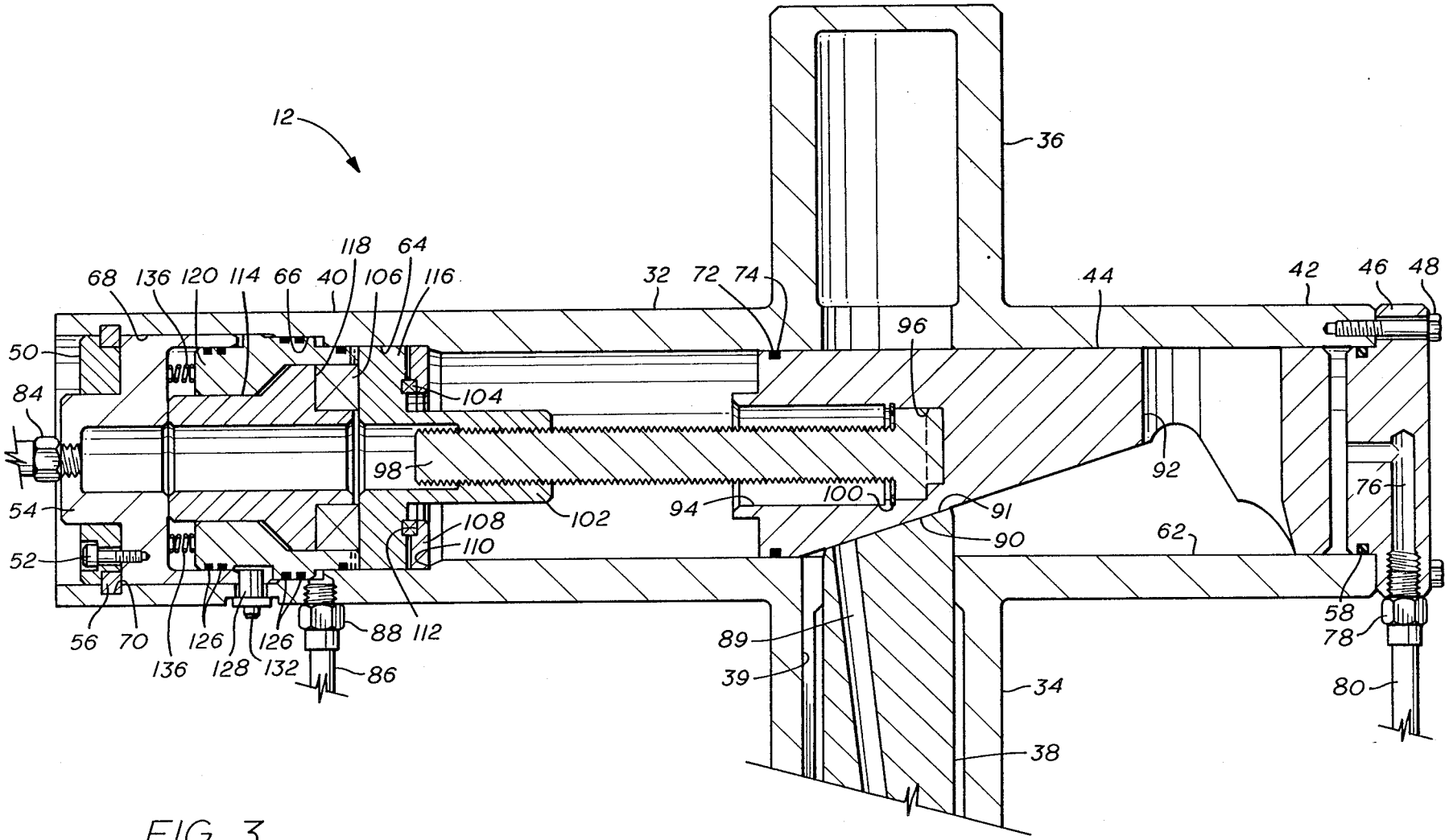
FIG. 3 is a sectional view similar to FIG. 2 with the ram tail rod in its closed position and the ram lock in its locked position prevent movement of the ram from its closed position.

Lock 12 is shown in FIGS. 2 and 3 in its unlocked position (FIG. 2) and in its ram locking position (FIG. 3). Lock housing 32 is generally cross-shaped with inner leg 34 connecting to bonnet 28 and receiving the outer end of tail rod 30 therein, outer leg 36 aligned with leg 34 and of sufficient size to receive the tail rod extension 38 which is secured to the outer end of tail rod 30 as shown and hereinafter described. The other two legs 40 and 42 of housing 32 are hollow and extend at right angles to legs 34 and 36 and are aligned with each other to allow the reciprocating movement of lock body 44 therein. Anti-rotation pin 37 is secured on the side of tail rod extension 38 and rides in groove 39 on the interior of leg 34 to prevent rotation of extension 38.

The outer ends of legs 40 and 42 are open and closed by closure plate 46 secured to the end of leg 42 by cap screws 48 and closure plate 50 secured within leg 40 by cap screws 52 threaded into cap 54 which is held within the interior of leg 40 by snap ring 56. Seal ring 58 seals between leg 42 and closure plate 46. Body 44 reciprocates in bore 60 in leg 40 and bore 62 in leg 42 which are aligned and of the same size to allow the necessary freedom of movement of body 44 as it reciprocates therein. Leg 40 includes first counterbore 64, second counterbore 66, third counterbore 68 and groove 70 in which snap ring 56 is positioned.

Since body 44 is to be moved within legs 40 and 42, seal ring 72 is provided in groove 74 extending around the exterior of the portion of body 44 closest to the outer end of leg 40. Fluid is delivered through passage 76 in closure plate 46 via fitting 78 and line 80 to the outer end of leg 42. Fluid is delivered to the outer end of leg 40 through line 82 and fitting 84 through to the interior of cap 54. Fluid is also delivered into the interior of leg 40 at counterbore 66 through line 86 and fitting 88. Passage 89 extends through tail rod extension 38 and tail rod 30 to deliver fluid to the inner or opening side of piston 24.

Figure 4:
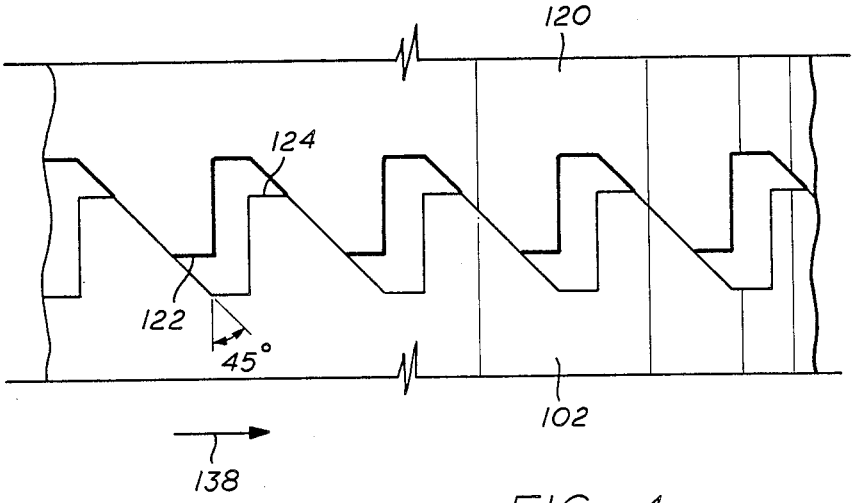
FIG. 4 is an enlarged partial view of the ratchet teeth of the nut and braking piston.

Body 44 includes wedge surface 90 on its underside as shown and bore 92 through which tail rod extension 38 extends when rams 14 are in their retracted position as shown in FIG. 2. Bore 94 extends into the outer end of body 44 in leg 40 and includes offset bore 96 which is provided to prevent rotation of threaded rod 98 which is held in bore 96 by snap ring 100. Nut 102 is threaded onto rod 98 and is supported within counterbore 64 for free rotation by bearings 104 and 106. Ring 108 is positioned within counterbore 64 against shoulder 110 between counterbore 64 and bore 60. Bearing 104 is supported in the recess 112 in ring 108 as shown. Flange 116 on nut 102 is positioned between bearings 104 and 106. Bearing 106 is positioned in recess 118 in sleeve 114 which is held in position by cap 54 which engages against the outer end of sleeve 114 as shown. Braking piston 120 is positioned in surrounding relationship to sleeve 114 and is provided with ratchet teeth 122 which engage with the ratchet teeth 124 in the outer end of flange 116. Ratchet teeth 122 and 124 are shaped to allow freedom of rotation of nut 102 during the locking movement of body 44 but to restrain against any reverse movement of body 44. Ratchet teeth 122 and 124 are best shown in FIG. 4. Such teeth are square on one side and tapered at 45 degrees on the other side.

Figure 5:
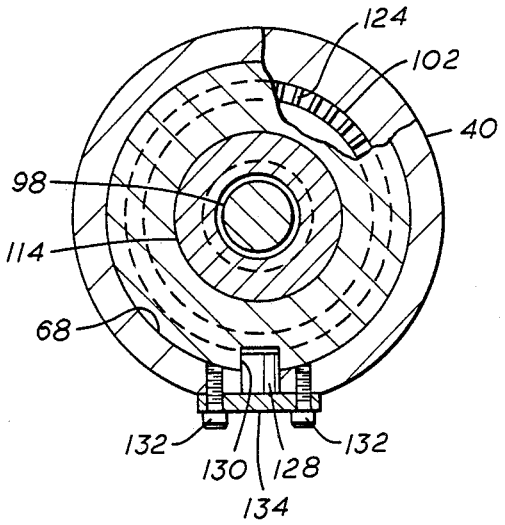
FIG. 5 is a sectional view taken along line 5—5 in FIG. 2 to show the means for preventing rotation of the braking piston.

Braking piston 120 is slidably mounted in counterbore 66 with suitable seals 126 and on the interior of cap 54 with pin 128 extending through leg 40 into slot 130 on the exterior of piston 120. Pin 128 is secured therein by cap screws 132 which extend through plate 134 into leg 40 as best seen in FIG. 5. Springs 136 are positioned on the interior of cap 54 and the outer end of piston 120 to urge piston 120 so that ratchet teeth 122 and 124 are maintained in engagement. Fluid under pressure delivered through line 86 and fitting 88 is sufficient to move piston 120 to the left as shown in the drawings against the force exerted by springs 136. This movement of piston 120 is sufficient to cause the disengagement of ratchet teeth 122 and 124 and allow nut 102 to rotate freely so that body 44 is not restrained in its retracting movement from locked position.

With the locks 12 installed on blowout preventer as shown in FIG. 1 and with both of the rams 14 in their retracted position with tail rod extension 38 positioned within leg 36 as shown in FIG. 2, fluid under pressure is supplied to the outer sides of pistons 24 to move rams 14 to their closed positions. Fluid under pressure is also delivered through line 82 and fitting 84 to the interior of cap 54. This pressure is exerted on body 44 to cause it to move in leg 40 toward leg 42. With tail rod extension 38 in its lower position its upper surface 91 is engaged by wedge surface 90 with sufficient force to ensure that rams 14 do not retract unless body 44 is first positively retracted as hereinafter described. In this position the components of the lock are positioned as shown in FIG. 3. During the movement of body 44, threaded rod is pulled through nut 102 which causes nut 102 to rotate. The rotation of nut 102 is possible since its ratchet teeth 124 will ratchet over the ratchet teeth 122 of braking piston 120 causing piston to move to the left as shown in the drawings. It should be noted that in the lock position of body 44, seal ring 72 is still positioned within leg 40 so that it will respond to pressure supplied through line 80, fitting 78 and passage 76 into the interior of leg 42.

The retraction of lock body 44 is accomplished by the supplying of fluid under pressure through line 86 and fitting 88 to cause braking piston 120 to move to the left a sufficient distance to disengage its ratchet teeth 122 from ratchet teeth 124 of nut 102. With braking piston 120 retracted by fluid pressure, fluid pressure exerted on body 44 from the interior of leg 42 causes body to retract into leg 40 so that the bore 92 in body 44 is aligned with tail rod extension 38 to ram 14 to retract ram 14 from its closed position and fluid pressure is delivered through passage 89 to piston 24.

The advantage of the improved lock of the present invention is that the engagement of wedge surface 90 with the outer end of tail rod extension 38 ensures that the rams 14 are maintained in their closed position. Further, the nut-braking piston combination prevents retraction of body 44 until it is positively retracted responsive to fluid pressure intentionally delivered to accomplish such retraction.

What is claimed is:

1. A ram locking apparatus for locking a ram in a blowout preventer housing by engagement of the outer end of a tail rod connected to the ram comprising a lock housing having two pairs of hollow aligned legs with one leg being mounted so that its hollow interior is positioned to receive the ram tail rod therein and the second pair connect to said one leg at an angle and with their interiors in communication with all legs, a body positioned within one of said second pair of legs of said lock housing and slidable therein responsive to pressure and having a surface for engagement with the end of the ram tail rod, means for supplying pressure for moving said body in said second pair of legs of said lock housing between a locked position engaging the end of the ram tail rod and a retracted position disengaged from the end of the ram tail rod, a threaded rod extending from the end of said body opposite from the tail rod engaging surface of said body, a nut threaded on said threaded rod and mounted in said housing leg containing said body for rotation therein and having means for restraining said nut against axial movement in said housing leg, a sleeve surrounding and spaced radially outward from said threaded rod, a braking piston surrounding said sleeve and having ratchet means engaging said nut to prevent rotation of said nut in the direction of retraction of said ram from closed position, and means for delivering pressure to said braking piston to slide it axially out of engagement with said nut to release said nut and allow retraction of said ram from closed position.

2. A ram locking apparatus according to claim 1 wherein said ratchet means includes a plurality of ratchet teeth on said nut, said annular braking piston having ratchet teeth engaging the nut ratchet teeth, said braking piston being slidable in aid housing leg between positions of engagement and disengagement of the nut ratchet teeth by the braking piston ratchet teeth, and means biasing said braking piston toward engagement of the nut ratchet teeth.

3. A ram locking apparatus according to claim 2 wherein the angle of slope on the inclined side of the ratchet teeth is approximately 45°.

4. A ram locking apparatus according to claim 1 wherein said lock housing is a hollow, cross-shaped structure with the ram tail rod extending into one leg and movable into the opposed aligned leg, and said body is positioned in a leg transverse to the rod leg.

5. A ram locking apparatus according to claim 4 including bearings rotatably supporting said nut within said housing.

* * * * *